US007699951B2

(12) United States Patent
Ward

(10) Patent No.: US 7,699,951 B2
(45) Date of Patent: Apr. 20, 2010

(54) FABRICATION OF COMPOSITE PANELS FROM CABLE MADE FROM ORIENTED AGRICULTURAL BYPRODUCTS

(76) Inventor: David Ward, 509 N. Mountain Ave., Ashland, OR (US) 97520

( * ) Notice: Subject to any disclaimer, the term of this patent is extended or adjusted under 35 U.S.C. 154(b) by 64 days.

(21) Appl. No.: 11/784,118

(22) Filed: Apr. 4, 2007

(65) Prior Publication Data

US 2007/0235894 A1 Oct. 11, 2007

Related U.S. Application Data

(60) Provisional application No. 60/789,671, filed on Apr. 6, 2006.

(51) Int. Cl.

| | |
|---|---|
| ***B32B 7/08*** | (2006.01) |
| ***B32B 38/08*** | (2006.01) |
| ***B32B 5/12*** | (2006.01) |
| ***B65B 13/02*** | (2006.01) |
| ***A01D 37/02*** | (2006.01) |

(52) U.S. Cl. ..... 156/91; 156/264; 156/296; 100/3; 100/8; 100/13; 56/131; 56/141; 56/341

(58) Field of Classification Search ..... 156/91, 156/242, 264, 278, 296; 264/261, 263; 100/3, 100/8, 13; 56/131, 141, 341

See application file for complete search history.

(56) References Cited

U.S. PATENT DOCUMENTS

| | | | | |
|---|---|---|---|---|
| 1,048,687 | A * | 12/1912 | Goodrick | 57/30 |
| 2,627,714 | A | 2/1953 | Freeman, Jr. et al. | 56/341 |
| 3,464,881 | A * | 9/1969 | Miller et al. | 428/105 |
| 4,109,448 | A * | 8/1978 | Kline | 56/13.5 |
| 4,399,745 | A | 8/1983 | Jorgensen et al. | 100/2 |
| 4,451,322 | A | 5/1984 | Dvorak | 156/461 |
| 5,322,738 | A * | 6/1994 | Breidenbach | 428/532 |
| 5,456,964 | A * | 10/1995 | Tamura et al. | 428/105 |
| 5,498,469 | A | 3/1996 | Howard et al. | 428/218 |
| 5,729,936 | A | 3/1998 | Maxwell | 52/220.2 |
| 5,730,830 | A | 3/1998 | Hall | 156/468 |
| 5,932,038 | A | 8/1999 | Bach et al. | 156/62.2 |
| 5,945,132 | A | 8/1999 | Sullivan et al. | 425/143 |
| 6,209,284 | B1 | 4/2001 | Porter | 52/794.1 |
| 6,596,209 | B2 | 7/2003 | Uhland et al. | 264/115 |

FOREIGN PATENT DOCUMENTS

| | | | |
|---|---|---|---|
| CA | 2312657 A1 | 12/2000 | 3/16 |

* cited by examiner

*Primary Examiner*—Michael A Tolin
(74) *Attorney, Agent, or Firm*—Timothy E. Siegel Patent Law, PLLC

(57) ABSTRACT

A method for creating a building material that makes use of a wheeled, moveable apparatus that moves through a field after the straw or other agricultural waste has been processed into tightly bound cables. Said cables are formed into woven mats, and said mats are bonded together to form flat or curved wall sections or panels.

12 Claims, 7 Drawing Sheets

FABRICATION OF COMPOSITE PANELS FROM CABLE MADE FROM ORIENTED AGRICULTURAL BYPRODUCTS

RELATED APPLICATION

This application claims priority from provisional application Ser. No. 60/789,671 filed Apr. 6, 2006.

BACKGROUND

The present invention has to do with a process designed to harvest straw or other fibrous material from the field and convert it to a structural insulating building material. There is a need for inexpensive building material for housing, erosion control structures and other structures that is not fully met by currently available building materials. Coincidentally, a great deal of agricultural material, such as straw and corn stalks, is essentially wasted.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention is a method for creating a building material that makes use of a wheeled, moveable apparatus that moves through a field after the straw or other agricultural waste has been processed into tightly bound cables. Said cables are formed into woven mats, and said mats are bonded together to form flat or curved wall sections or panels.

In a second separate aspect, the present invention is an apparatus for producing a cemented product from a cable made from agricultural waste. It is comprised of a wheeled, moveable frame that includes a capturer adapted to capture strands of cable from the field, a cutter to cut them to length, a loom to weave them into a continuous mat, and a spool on which to store the mat.

In a third separate aspect, the present invention is a method for producing a structural wall system from cable made from agricultural waste so that the orientation of the cable and the bonding of said cable produces a structure that is capable of sustaining both compressive and dynamic sheer loads.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE PREFERRED

Figure 1:
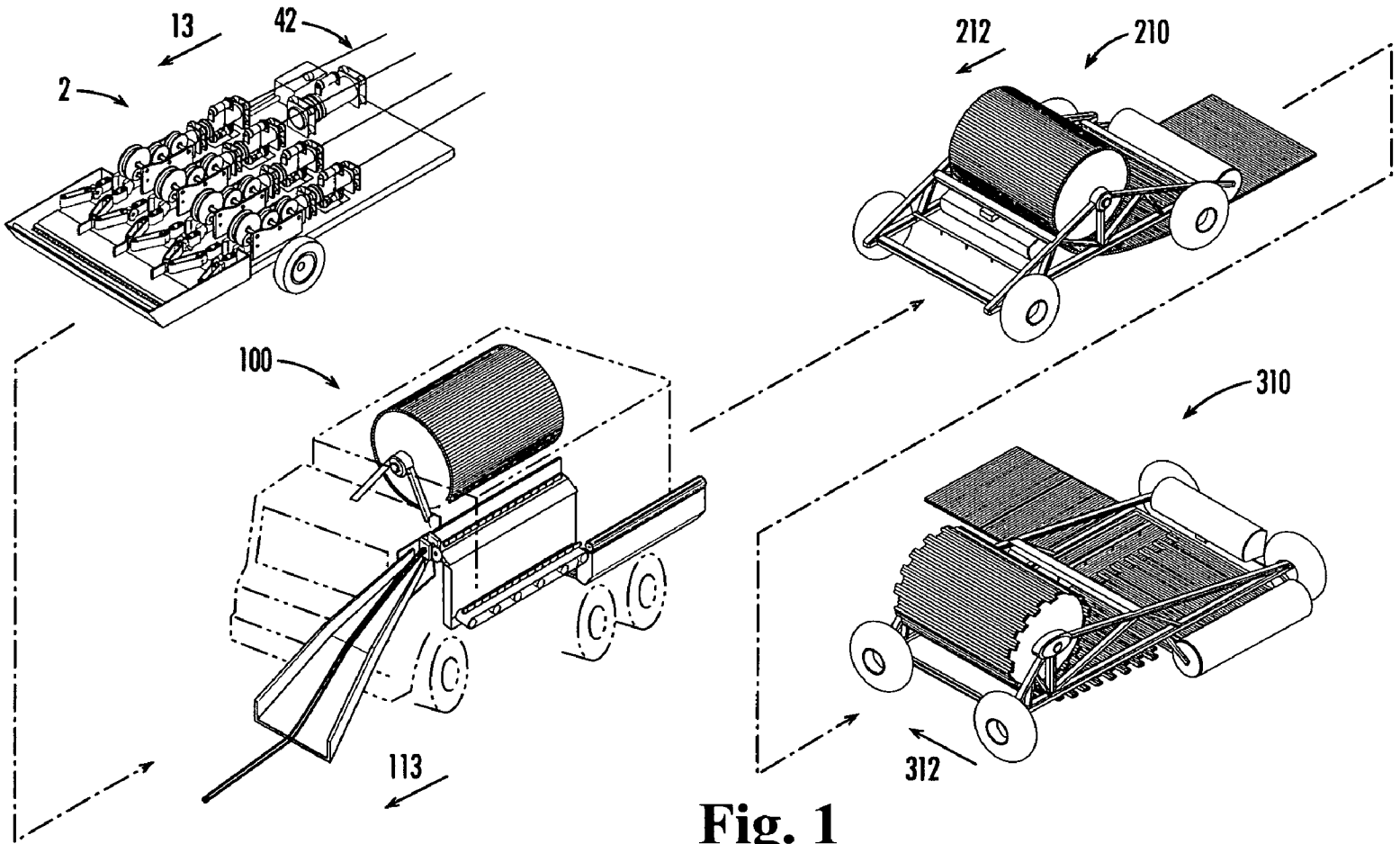
FIG. 1 is a perspective drawing of an assemblage of machinery including a straw harvester/cable fabricator; a stack-wagon/loom; a first mat-layout carriage and second mat-layout carriage.

Referring to FIG. 1, in gross overview a preferred method for carrying out the invention, a mobile straw harvester and cable fabricator 2 is pulled through a field in the direction of arrow 13. As it is pulled, it creates a set of cables or strands 42 that are made of agricultural material bound in cable form by a tension member, such as nylon or sisal twine. Cables 42 are deposited on the ground in lengths that are limited only by the dimensions of the field being re-harvested. After cables 42 are permitted to dry, a stack wagon 100, moving in the direction indicated by arrow 113, collects cables 42, cuts them to length (8 feet in the preferred embodiment), and binds the ends to keep the spirally wound yarn that holds the cables together from unwinding.

The cut lengths of cable 42 are then woven and/or sewn into a continuous mat held together by strands of twine, such as bailing twine (either sisal of polypropylene depending on the degree of non-organic material that is acceptable). In a preferred embodiment this is accomplished on a stack wagon 100, which is specialized for this task. The completed mat material 120 is wound on a drum 116 that is rotatably mounted on a truck or wagon as it moves through the field.

In the next phase, the mat material 120 is transferred from stack wagon 100 to a first layout wagon 210, which unrolls the material 120 on a level field, as it moves in the direction indicated by arrow 212. The length of this unrolled section is limited only by the length of the field. The mat section 214 so laid out is cut from the remainder of the mat on drum 216 and any twine ends are tied together to prevent unraveling. The mat is sprayed with a coating of matrix material adapted to bind additional material to mat section 214.

A second layer of mat is then added by a second layout wagon 310, moving in the direction indicated by arrow 312. In the second layer the cable segments are arranged in perpendicular manner to the cable segments of the first layer. The second layer is pressed firmly into the matrix material to form a good bond. A third or even fourth layer may be added, as desired, with time allowed between successive layers for moisture to evaporate to avoid entrapment of moisture in the center of the wall section. The cable segments of the top layer are arranged in parallel manner to the cable segments of the bottom layer.

Once the resulting panel has dried it is cut to the desired length. Panels may be made in any length desired, limited only by the ability to move the panels economically to the building site. In one preferred embodiment, the mat may be cut into panels that conform to traditional building methods accustomed to 4 ft. by 8 ft. modules.

Figure 2:
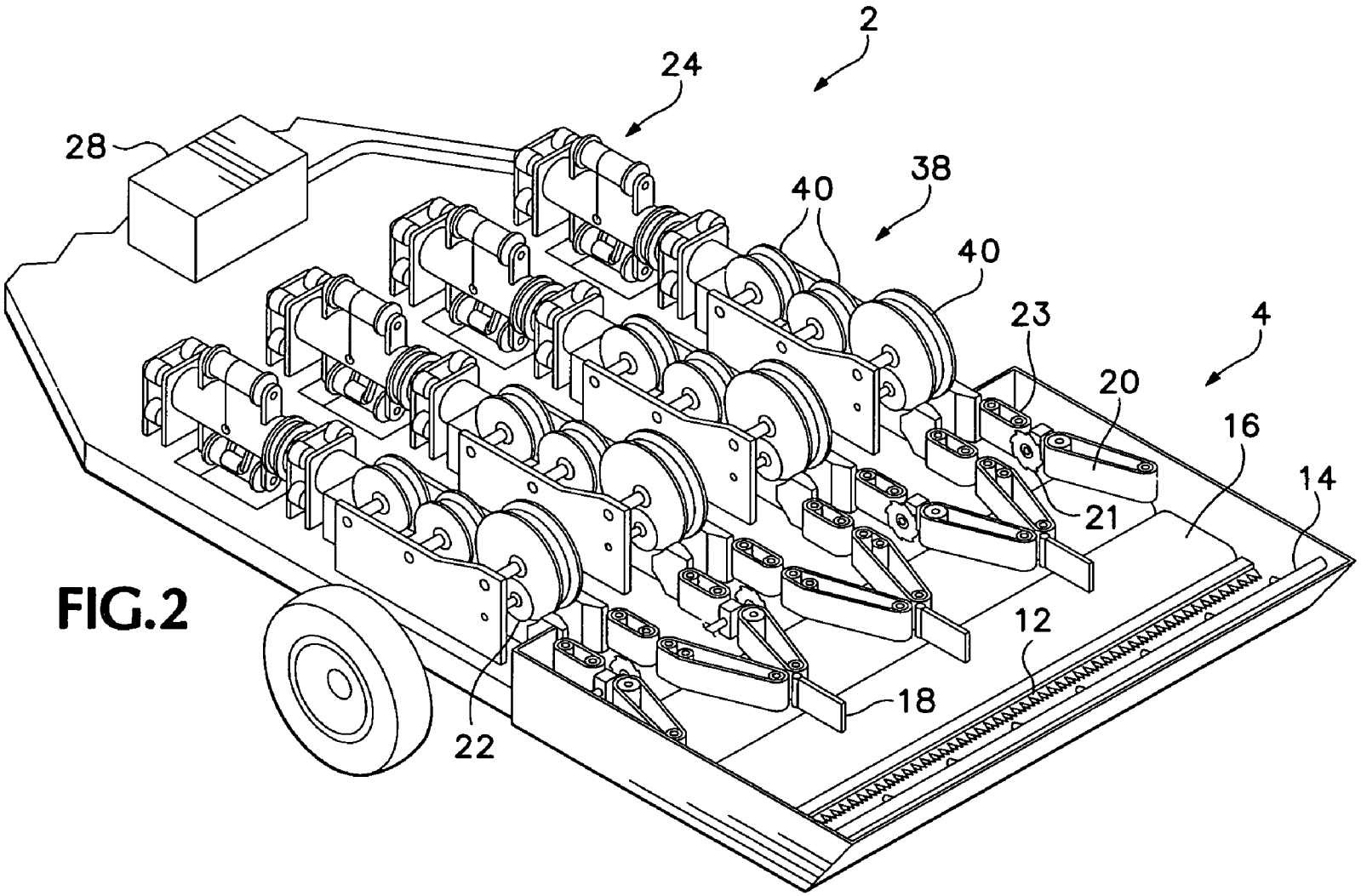
FIG. 2 is a perspective drawing of the straw harvester/cable fabricator of FIG. 1.
Figure 3:
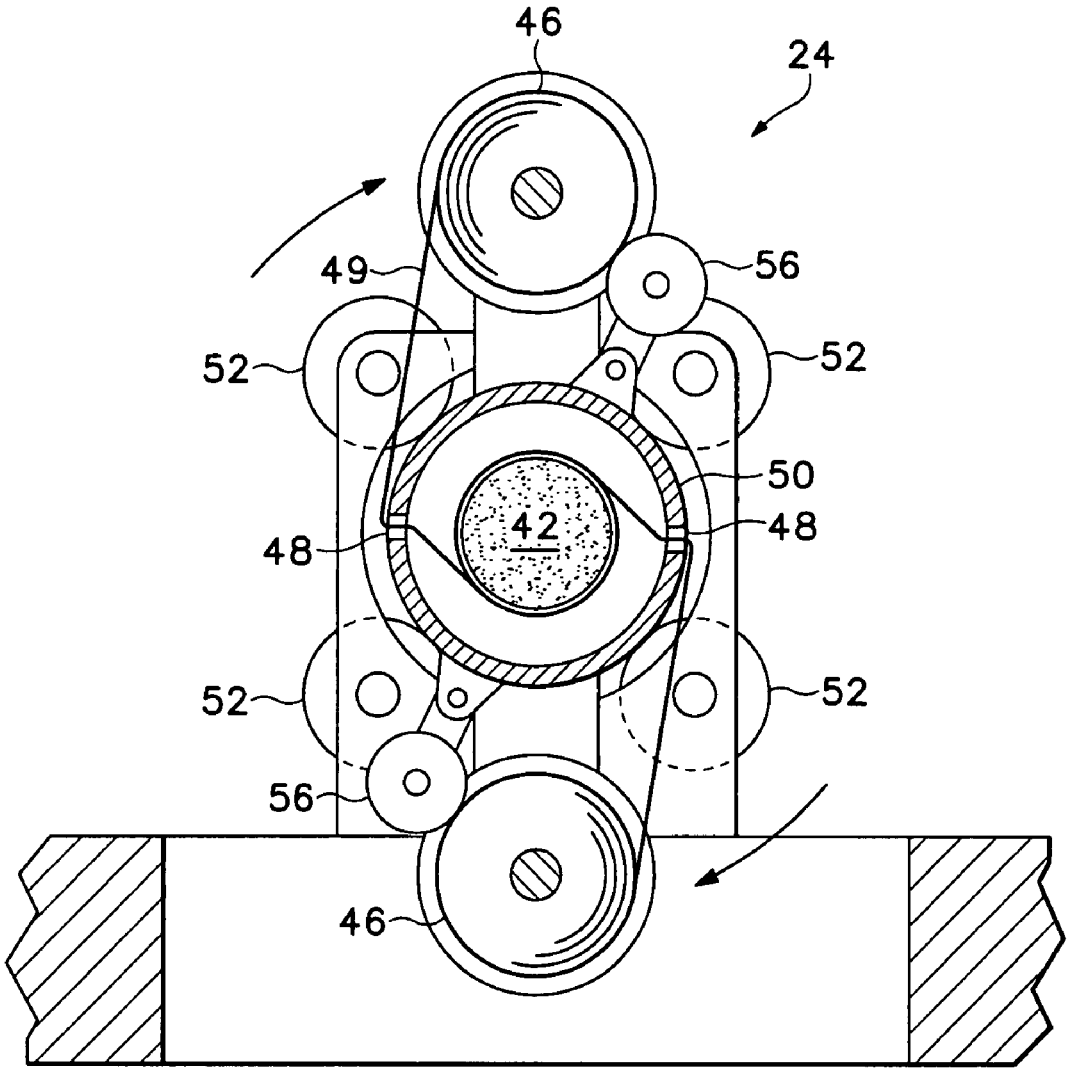
FIG. 3 is a sectional view of a cable wrapper that is a part of the straw harvester/cable fabricator of FIG. 2.
Figure 4:
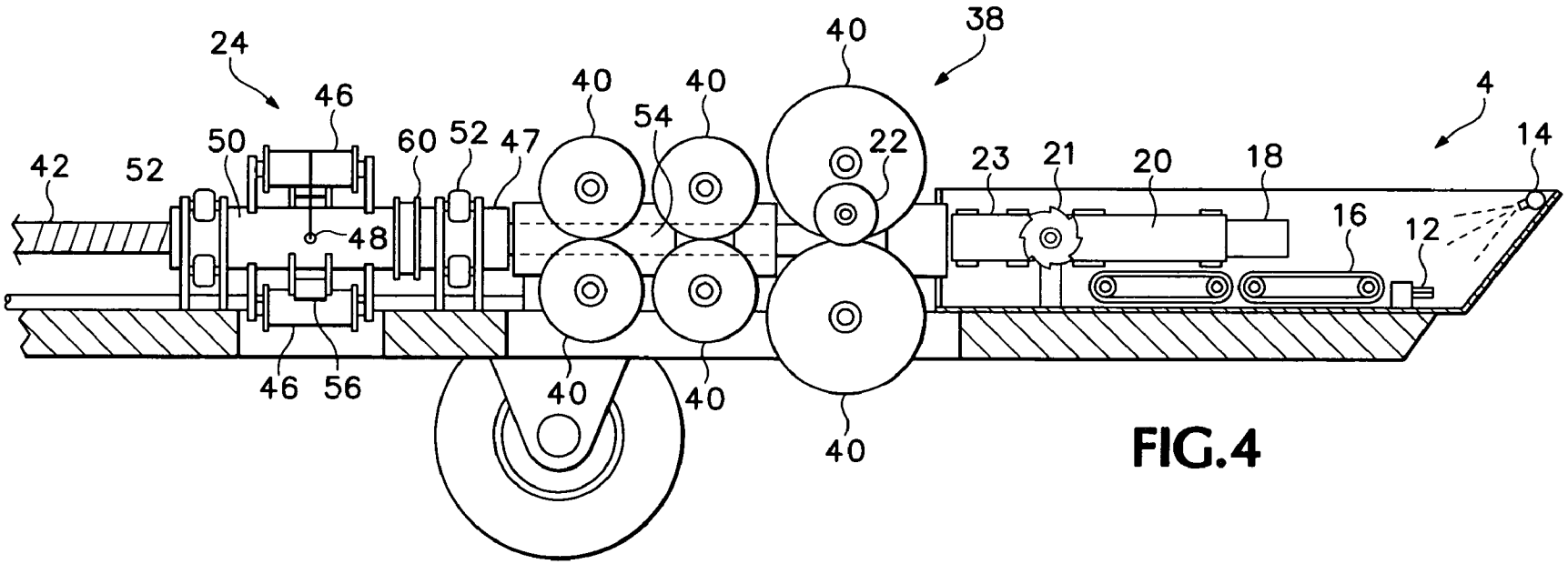
FIG. 4 is a side sectional of the straw harvester/cable fabricator of FIG. 1.

In greater detail, referring to FIGS. 2, 3 and 4, a preferred embodiment of a mobile straw harvester and cable fabricator 2 is in the form of a wheeled moveable apparatus that harvests straw and fabricates it into four cables 42 (FIG. 2). The mobile straw harvester and beam fabricator 2 is attached to a tractor by a hitch (not shown) and receives power from the tractor through a power take-off (not shown). In the preferred embodiment a tractor pulls the straw harvester 2 by the hitch through a field of straw capturing straw that has been left after the harvesting of grain heads. In an alternative embodiment, the harvester may be self propelled with its own engine. Other raw materials could, however, be used as a substitute. For example, bamboo, hemp, chaparral, or other organic substances with fibrous, cellulose-based, stem material could be used. Differing characteristics of the raw material would, of course, result in the production of a finished product whose characteristics, and thus uses, would differ from those obtained when straw is used.

As the tractor pulls the mobile straw harvester and beam fabricator 2 through a field of straw left after the harvesting of grain heads a cutter bar 12, or capturer, cuts and feeds the straw into the harvester. In an alternative embodiment the straw has already been cut and lies in the field in windrows. In such case only a pick-up belt would be needed instead of the cutter bar 12. Either way, both of these embodiments describe standard equipment for harvesting machines in the industry, which will be familiar to skilled persons.

When the feed stock (typically straw) is gathered into the harvester a hollow metal tube with a set of spray nozzles 14 sprays the straw with a matrix mixture that is held in, and pumped from, a reservoir 28 (FIGS. 1 and 4). The matrix mixture has both moisturizing and adhesive properties. The moisturizing properties are necessary so that the straw can be more easily compressed into a compact cylinder without damaging the structure of the material. The adhesive properties cause the straw to bind together more effectively during subsequent steps of the beam fabrication process.

Regulating the moisture so that the feed stock can be more easily compressed into a compact cylinder without damaging the structure of the material is an important element of the present embodiment. As noted in the background section, the structural qualities of straw, in its natural undamaged form, provide significant compressive strength. Compressive strength is precisely the type of strength needed in building materials that are used to support heavy loads. This is one great advantage this process has over the prior art.

In addition to the moisturizing value, the mixture that is sprayed onto the feedstock through the hollow tube with multiple spray nozzles 14 also has a binding element. Hence various binders such as clay, boiled linseed or soybean oil, rosin, as well as synthetic and natural adhesives may be part of the mixture that is sprayed onto the feed stock after it is cut and harvested.

After the feed stock is sprayed with the moisturizing and binding elements of the matrix mixture it is carried by a meshed feed belt 16 into one of a set of four parallel compression sections 38. The feed belt is meshed to allow excess moisturizing and binding mixture to fall through to an overspray tank (not shown) that catches the excess mixture for reuse.

A set of three movable vanes 18 separate the feed stock into four streams which enter into one of the four compression sections 38 by passing between a series of converging belts 20 that aligns, or arranges, the straw stems so that they are parallel to each other, and simultaneously compresses them so that they will feed into a set of compression rollers 40.

The compression sections 38 are preceded by a set of four first flow limiting cutters 21 and four sets of parallel belts 23. The first flow limiting cutters 21 and parallel belts 23 limit the swath of feed stock entering the compression sections 38 according to the density of the swath. Greater densities require smaller widths and lesser densities require larger widths.

In an alternative embodiment the parallel belts 23 compress the straw stems from the top and bottom as well as from the sides. On three sides of the feed stock the belts 23 are fixed, while on the fourth side (top, bottom, or either side) one of the belts 23 is free to move (in a horizontal or vertical direction) to accommodate for changes in the volume of the material entering the compression process. Rollers may be used in the place of belts 23, depending on the material being processed.

After passing through the set of parallel belts 23, but before entering the compression rollers 40, a second flow limiting cutter 22 (FIGS. 2 and 3) removes more excess feed stock material and returns it to the field. Removing excess feed stock assures that only the desired volume of feed stock enters the compression rollers 40, and that the diameter of the resulting straw strand 42 (FIGS. 2 and 3) is uniform. It also prevents the compression rollers 40 from becoming overloaded. Returning excess feed stock to the field is also beneficial in the sense that it returns organic matter to the soil for the purpose of preserving tilth. Alternatively, the excess material can be further refined and added to the moisturizing and adhesive mixture.

Feed stock material next passes through the set of compression rollers 40, each of which has a transversely concave outer surface. The distance between the upper rollers 40 and the lower rollers 40 decreases progressively so that the feed stock is gradually compressed to the desired density and diameter.

During compression, the feed stock is held in place by a fixed roller die 54 made from a hard polymer resin (FIGS. 2 and 3). The roller die 54 guides the feed stock through the compression section and into the subsequent wrapper section. The roller die 54 is a guide block that is machined to be in contact with both the concave face of the rollers and the outer rim of the rollers. As such, the roller die assures that the straw material remains compressed within a columnar space and that no straw slides through the gap between the rollers and the die, which would eventually lead to clogging up the system. The compression rollers 40 are able to drive the straw strand 42 through the roller die 54 because the friction created by the die 54 is less than the friction on the compression rollers 40.

Figure 5:
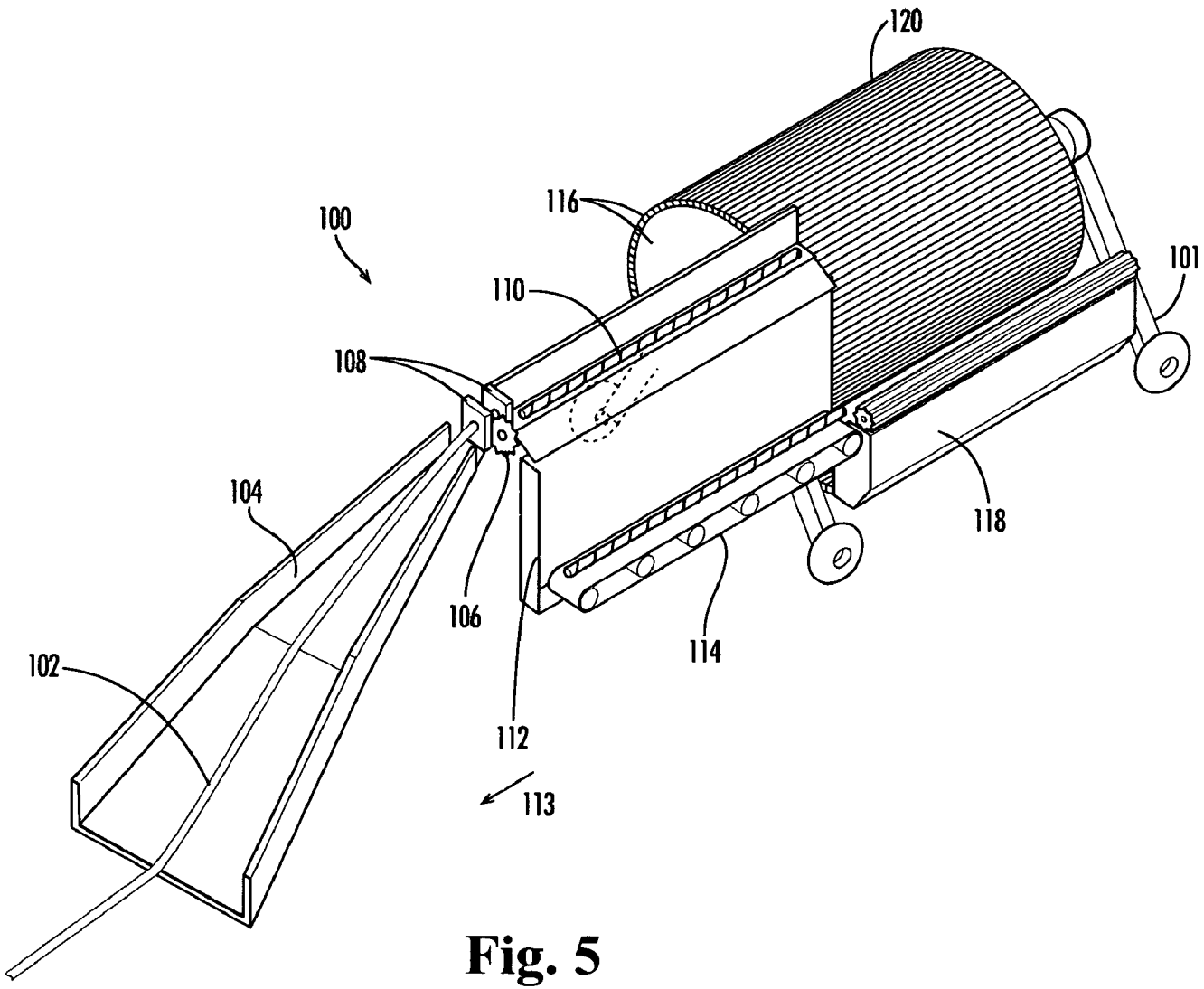
FIG. 5 is a perspective view of the stack-wagon/loom of FIG. 1.

The resulting cylinder of feed stock is fed into the first wrapper, or binder, section 24 diagramed in FIGS. 2, 3, and 5. The first wrapper section entrance nozzle 47 is machined to mate with the exit of the roller die 54 so that the compressed straw column does not have space to expand before it passes into the first wrapper section 24. The first wrapper section 24 consists of a rotating assembly 50 holding two spools 46 of yarn, twine or wire 46 which, fed through an eyelet 48, is wound around the cylinder as it passes through the center forming a spiral wrapping which binds the material securely together. The tension of the yarn, twine or wire 49 (FIG. 5) is regulated by a tensioning roller 56. The rotating assembly 50 is supported in its frame by sets of rollers 52 at each end, and is powered by a drive belt 58 (FIG. 3) attached to the rotating assembly's drive belt pulley 60.

The result of the foregoing continuous process are four straw cables 42, one from each of the four first wrapper sections 24, each of equal diameter, which depending on the embodiment and setting may range from 1" to 9". Each cable 42 is bound together with a spiral wrapping of yarn, twine or wire. A twine made out of polyester yarn would work well with the preferred embodiment.

FIG. 4 shows four separate compressing and wrapping units 38 mounted side-by-side in the mobile straw harvester and cable fabricator. The width of the harvested swath necessary to accommodate four parallel wrapping units 38 would equal that made by harvesting equipment currently available.

The four separate units 38 allow four streams of material to be deposited on the ground to dry and await further processing.

FIG. 5 shows a more detailed depiction of the stackwagon 100. The entire apparatus is mounted on a mobile carriage 101 which may be drawn behind a tractor or may be self-propelled. For simplicity, one cable 102 is shown moving up the ramp 104. At a predetermined length, the a pair of binder mechanisms 108 are activated simultaneously to place two restraining bindings of twine, wire, tape or other material on the cable 102. The bindings are spaced far enough apart to allow a cutter 106 to sever the cable without damaging the binding. The length of the resulting cable segments 110 is determined by the height of the panel desired and in one preferred embodiment is equal to 8 feet. The cable segments 110, each now bound at each end to prevent the spiral winding running the full length of the cable from loosening, are deposited in a hopper 112.

As the operation continues, the cables in the hopper 112 are released individually onto a shuttle conveyer 114, which moves segments 110 toward a loom mechanism 118. Mechanism 118 contains spools of twine (not shown) arranged in pairs which constitute the warp of the mat. The technology of making a loom is well developed and will not be discussed here. As the pairs of warp twines are separated by the loom mechanism 118, a segment of cable is inserted from the shuttle conveyer 114. The warp threads are separated in the opposite direction, and the next cable segment 110 is inserted. The resulting mat material 120 of cable segments 110 is wound on a drum 116 and stored for the next phase of the operation.

Figure 6:
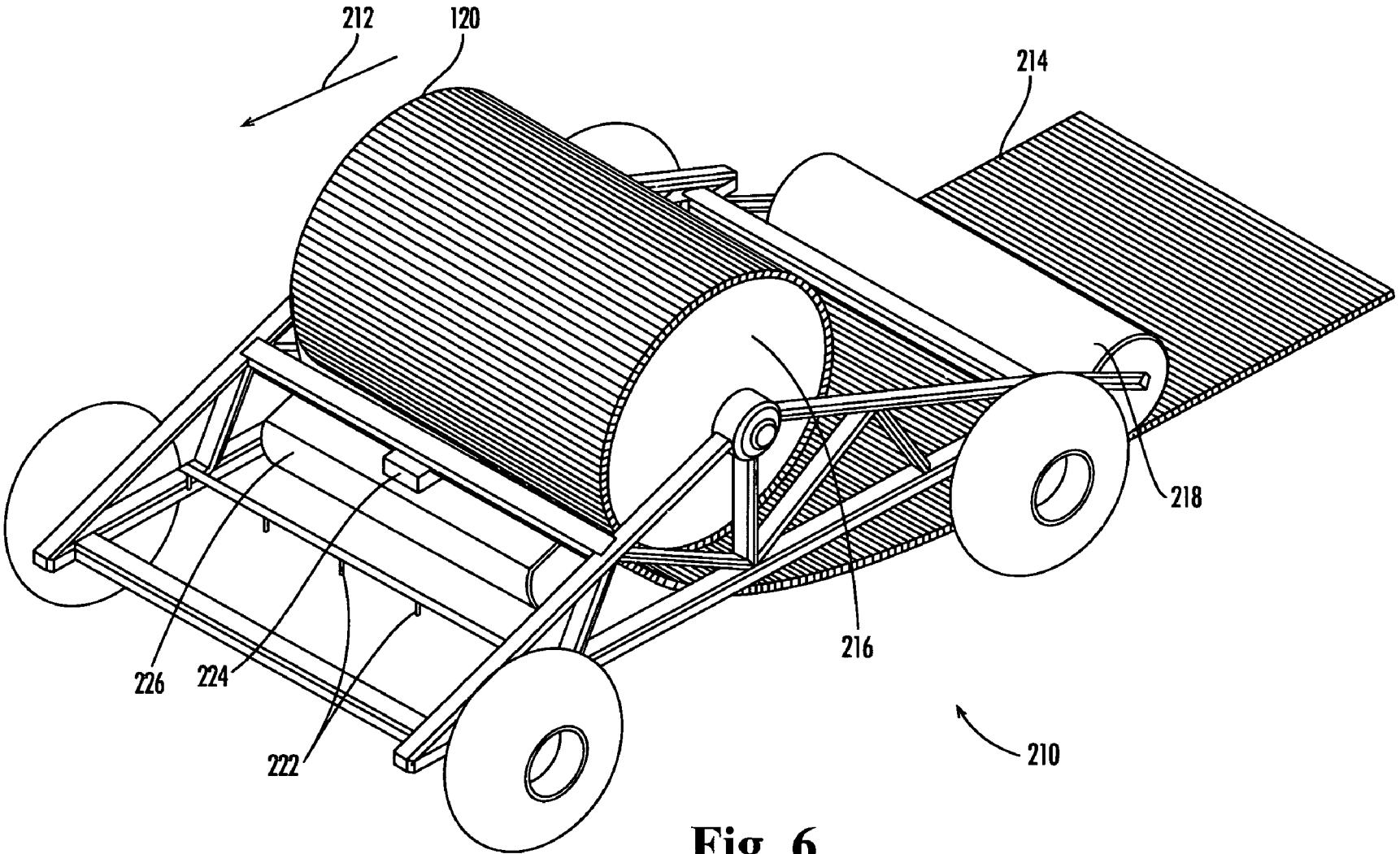
FIG. 6 is a perspective view of the first mat-layout carriage of FIG. 1.

FIG. 6 shows the mat layout carriage 210 which may be drawn by a tractor or in an alternative preferred embodiment is self propelled. The carriage is designed to move in the direction of arrow 212 through a leveled field. A drum 216 bearing mat material 120 is shown mounted on the carriage 210. In one preferred embodiment a drum 116 is transferred from a stack wagon 110. In an alternative preferred embodiment, mat material 120 is transferred by unwinding it from a stack wagon drum 116 to a layout carriage drum 216.

The process of producing a wall panel from material 120 begins when a first layer 214 of material 120 is unrolled from the carriage 210 onto the ground or onto support blocks (not shown). The carriage 210 is then turned around and straddling the first layer 214 makes a second pass over the existing mat. Spray nozzles 222 coat the top of layer 214 with a matrix material supplied by a pump 224 from a storage tank 226. Binding agents may be added to the matrix material or sprayed on layer 214 to improve adhesion between the matrix material and the straw.

Contemporaneously, drum 216, which travels directly behind nozzles 222 deposits an additional layer of material 230 onto the coated first layer 214 and is pressed in place by roller 218. Additional passes may be made to build up the wall panel to the desired thickness.

Figure 7:
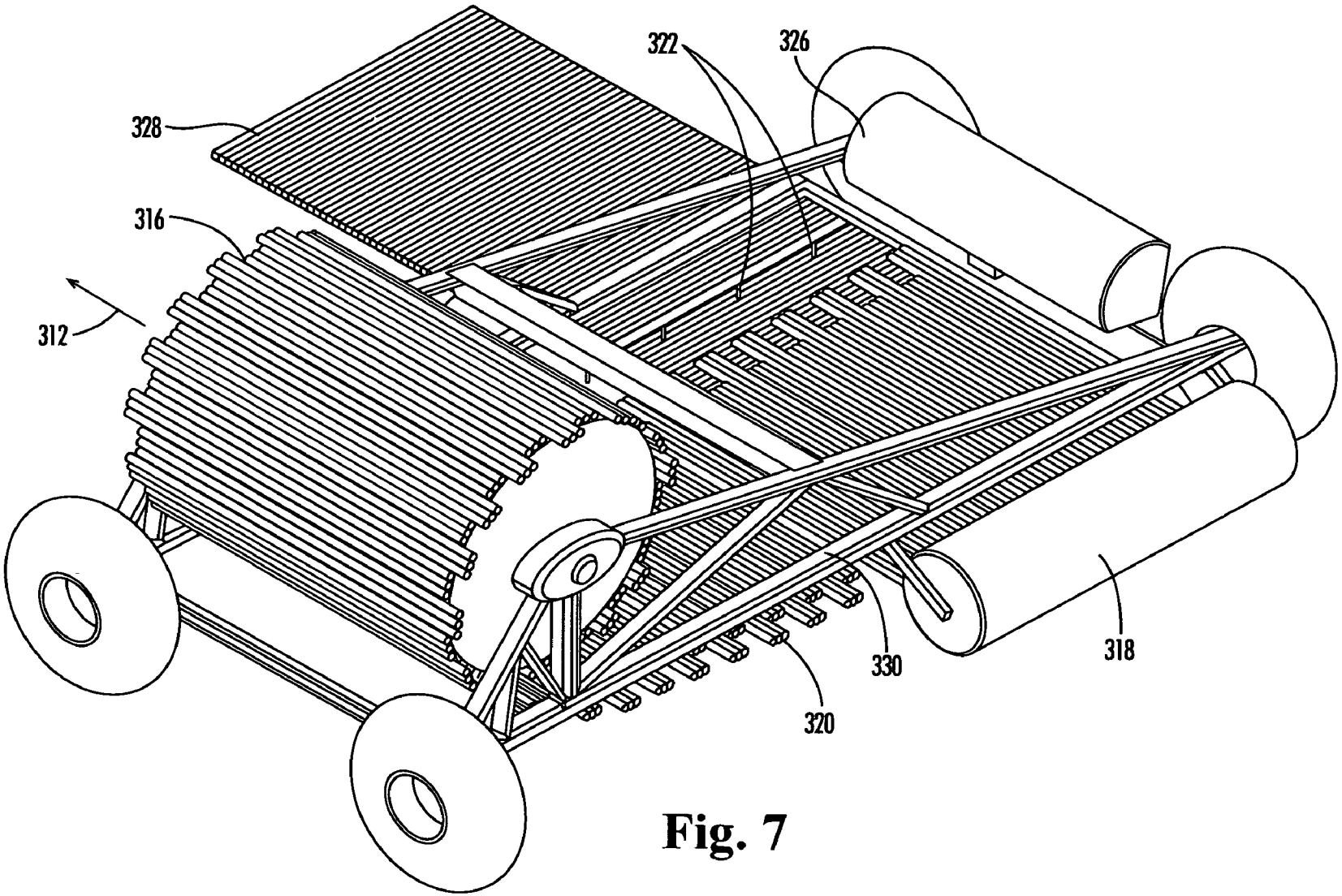
FIG. 7 is a perspective view of the second mat-layout carriage of FIG. 1.

FIG. 7 shows a second layout carriage 310 adapted to apply layers of material 314 having cable segments 110 oriented perpendicularly to those segments 110 of the layers built up by the layout carriage in FIG. 6. The carriage 310 shown is adapted to move in the direction of arrow 312 straddling the partially formed wall panel 328, created by carriage 210. The second layout carriage 310 is equipped with a spray tank 326 and nozzles 322, a drum 316 of mat material 314 and a pressure roller 318.

For the purpose of weaving the mat material 314 carried by second carriage 310, the loom 118 is adjusted to weave a mat 314 as shown in FIG. 7 in which cable segments are staggered either individually or in groups of two or three as shown. At regular intervals equal to the width of the wall panel being formed (8 feet in the preferred embodiment), one or more cables are omitted from the mat to crate a "cut zone" 330. The warp twine is either tied, bound with metal clamps, or fused together with heat so that a cut may be made through the cut zone 330 without allowing the mat to unravel. There are multiple devices available commercially to perform these tasks and they will not be specifically discussed. The mat, with its gaps, is left uncut and wound on the drum 316 ready for application.

FIG. 7 shows a section of mat with the gap shown at 330 unrolled across a section of wall panel 328 (begun with the layout of material layer 214 by wagon 210). A set of knives cut the mat from the roll at the gap 330 and the section of mat is aligned and integrated so that the staggered ends of the cables intermesh with the cable ends of the previous section of mat. As with the previous layers, a binding material has been sprayed on the exposed layer and the mat is pressed into place with a pressure roller 318. The carriage then moves along the wall section to spray binding material and apply the next section of mat into position to mesh with the adjoining section. One or more additional layers are applied with their joints staggered by sufficient distance, in practice about 0.5 meters, to avoid a weak zone.

The complete the lamination process, two or more additional layers of mat are laid down, oriented in the same direction as the first layers. The completion of the wall section is described above and may include pins or other ties to strengthen the bond between layers, and cutting the panel to the desired size.

In an alternative embodiment, individual cable segments would be fed from the hopper into a channelized bed which would hold each cable individually in a parallel array. Rollers or other feed mechanisms move each cable segment along at the same speed as the machine is moving over the ground so that the cable segments are deposited on the panel assembly in a single layer parallel to the longitudinal axis of the panel with no space between the cables. The ends of the cable segments are staggered to avoid a weak zone. The final layers would again be added parallel to the first layers, thereby forming a continuous panel multiple layers of cable segments, the segments in the outer layers being at right angles to the orientation of the mat, and those in the middle being parallel to the orientation of the mat. In an alternative embodiment, cable segments may be arranged in diagonal patterns.

In the final stage of producing the panel material, pins or staples made of bamboo or other metallic or non-metallic material would be inserted at regular intervals through all layers of the mat to add additional strength to the wall structure by allowing the internal sheer loading between layers to be distributed evenly through the entire thickness of wall structure.

In an alternative embodiment the tasks of carriages 210 and 310 would be performed in a large structure, preferably equipped with a conveyer belt, for unrolling mat material 120 and mat material 314 and building up a complete panel. This system permits the method of producing panels to be performed in the rain, as well as on sunny days.

Once the resulting panel has dried it is cut to the desired length. In one embodiment, this procedure is performed by a saw mounted on a traveling cart so that it can be positioned to cut either parallel to the axis of the mat or perpendicular to it. Panels may be made in any length desired, limited only by the ability to move the panels economically to the building site. In the preferred embodiment, the panels are cut to the length of the wall of the proposed building. Windows are cut in the wall in the field. A header and mudsill may be attached at this time and held in place with pins and with wire of plastic mesh attached to the header or sill and extending part way down both surfaces of the wall section. The entire structure can then be lifted by a crane onto a truck. It is then carried in a vertical position to the building site where it is set in place by another crane.

In an alternative embodiment, the mat may be cut into smaller panels to conform to traditional building methods accustomed to 4 ft. by 8 ft. modules.

Curved structures may be produce by placing supports of varying thickness under a section of wall during the lay-up process to form a curved wall section.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method for creating a structural panelized building material:

(a) providing a cable of agricultural product pieces that have been bound together with a tension member in a manner that maintains the structural integrity of the agricultural product pieces;

(b) providing a wagon;

(c) moving said wagon through a field bearing said cable of agricultural product pieces;

(d) cutting said cable into segments on said wagon, all said pieces having a uniform length; and (e) using tension members to bind said segments together into a mat, on said wagon.

2. The method of claim 1, wherein an additional cable is used to create said mat.

3. The method of claim 1, wherein additional cables are used to create said mat.

4. The method of claim 1, wherein said mat is a first mat and further including forming a second mat in manner described by paragraphs (c) through (e) of claim 1 and stacking said second mat on said first mat to form a two-ply composite.

5. The method of claim 4, wherein said second mat is placed in an orientation wherein said cables are at an angle relative to cables of said mat.

6. The method of claim 5, wherein said angle is a 90 degree angle.

7. The method of claim 1, further including coating said mat with cementitious material.

8. The method of claim 7, further including placing a second flexible mat on top of said mat coated with cementitious material.

9. The method of claim 8, further including placing further cementitious material on said second flexible mat.

10. The method of claim 1, wherein said mat is moved to the ground or on a flat drying surface after it is finished.

11. The method of claim 10, wherein said mat is a first mat, having a face, and wherein a second mat is laminated or bonded to the face of said first mat as it rests on the ground.

12. The method of claim 1, wherein said mat is a first mat and further including forming a second mat in manner described by paragraphs (c) through (e) of claim 1 and wherein both first and second mats have staggered cables and wherein said second mat is placed adjacent to said first mat such that said staggered cables of said first and second mat are mutually interposed with one another and wherein said first and second mats are joined to each other so that the ends of the individual cables are interlocking.

* * * * *